US008448564B2

(12) United States Patent
Hart

(10) Patent No.: US 8,448,564 B2
(45) Date of Patent: May 28, 2013

(54) SIDE EXIT FAUCET SERVER

(75) Inventor: Burton L. Hart, Auburn, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 725 days.

(21) Appl. No.: 12/301,256

(22) PCT Filed: May 21, 2007

(86) PCT No.: PCT/US2007/069397

§ 371 (c)(1), (2), (4) Date: Jan. 7, 2009

(87) PCT Pub. No.: WO2007/137238

PCT Pub. Date: Nov. 29, 2007

(65) Prior Publication Data

US 2009/0188652 A1 Jul. 30, 2009

Related U.S. Application Data

(60) Provisional application No. 60/747,796, filed on May 20, 2006.

(51) Int. Cl.
*B67D 7/00* (2010.01)
*B67D 1/00* (2006.01)

(52) U.S. Cl.
USPC ..... 99/275; 99/290; 222/131; 222/183; 222/185.1; 220/592.18

(58) Field of Classification Search
USPC ..... 99/275, 290, 323.3; 222/185.1, 131, 222/183; 220/592.16, 592.18, 592.2, 592.22, 220/592.28
See application file for complete search history.

(56) References Cited

U.S. PATENT DOCUMENTS

| | | | |
|---|---|---|---|
| 2,372,081 | A | 3/1945 | Haldane |
| 3,830,406 | A | 8/1974 | Robb |
| 5,927,557 | A | 7/1999 | Busick et al. |
| 5,944,225 | A | 8/1999 | Kawolics |
| 5,971,218 | A | 10/1999 | Le |
| 6,637,624 | B1 | 10/2003 | Lassota |
| 6,644,510 | B2 | 11/2003 | Kawolics et al. |
| 6,840,407 | B2 | 1/2005 | Lassota et al. |

OTHER PUBLICATIONS

International Search Report issued in application No. PCT/US07/69397 (2008).

*Primary Examiner* — Reginald L Alexander
(74) *Attorney, Agent, or Firm* — Barnes & Thornburg LLP

(57) ABSTRACT

A server (20) for retaining and dispensing a heated beverage. The server includes an insulated server body (23) for reducing heat transfer of heat from the liquid beverage retained therein. A sump (60) is provided in the server body at a lower portion thereof for draining beverage from the server. The sump has a minimal cross sectional area to further reduce heat transfer from a volume of liquid beverage retained in the server to the sump. A faucet (42) is attached to the server and communicates with the sump through a port (76). An interface hub (52) is positioned between the faucet and the server for reducing heat transfer from the liquid beverage to the faucet.

18 Claims, 6 Drawing Sheets

SIDE EXIT FAUCET SERVER

CROSS-REFERENCE TO RELATED APPLICATION

This patent application is a U.S. Nationalization of international application no. PCT/US2007/069397, filed May 21, 2007, which claims the benefit of priority under 35 U.S.C. §119(e) to U.S. Provisional Patent Application No. 60/747,796, filed May 20, 2006. The disclosures set forth in the referenced applications are incorporated herein by reference in their entireties, including all information as originally submitted to the United States Patent and Trademark Office.

BACKGROUND

A variety of servers have been developed to receive, retain and dispense beverages. Such servers are often referred to as "thermal servers." A thermal jacket is provided as a component of the server to retain heat in a beverage produced, dispensed into and retained by the server. The thermal jacket may be in the form of a glass material providing a "thermos" type container or of a metallic material. In either form, a variety of materials could be used with additional coatings or substances to help increase the heat retention properties of the container.

A variety of containers have been formed comprising two layers of material with an evacuated area between the two layers. For example, one embodiment might include two spaced apart layers of stainless steel material. The stainless steel material is formed so as to provide a small space in between the inner layer and the outer layer. The layers are sealed so as to provide an evacuated area surrounding the volume of liquid retained in the server. Alternatively, the container may be insulated by means other than an evacuated space, such as, by way of example of but not limitation, foam insulation material, inert gas, or any other material providing an insulation function.

One of the complications that arise with servers is the exit which is provided to a dispensing faucet. The exit includes some form of passage or hole through the inner layer and outer layer including a passage connected between the hole and a corresponding faucet. The faucet might be in the form of a controllable faucet having a handle and operatively attached controllable valve or stopper. The faucet allows the user to control the dispensing of beverage, such as coffee from the server.

It is preferable to provide a hole, which has a small cross area surface. This dimension and characteristic helps define the degree or magnitude of heat transfer between a volume of liquid retained in the server and that which is passing to the faucet. It is desirable to provide a connection between the hole and the faucet which is as short as possible or otherwise minimized the volume of any liquid between the server and faucet. This helps reduce or eliminate the amount of liquid retained in the passage between the hole and the faucet. Additionally, it is also desirable to minimize the thermal mass of the material connecting the faucet to the server so as to further minimize heat transfer. Further, it may be desirable to minimize the mass of the faucet to minimize heat transfer.

BRIEF DESCRIPTION OF THE DRAWINGS

The present disclosure will be described hereafter with reference to the attached drawings which are given as a non-limiting example only, in which.

Figure 1:
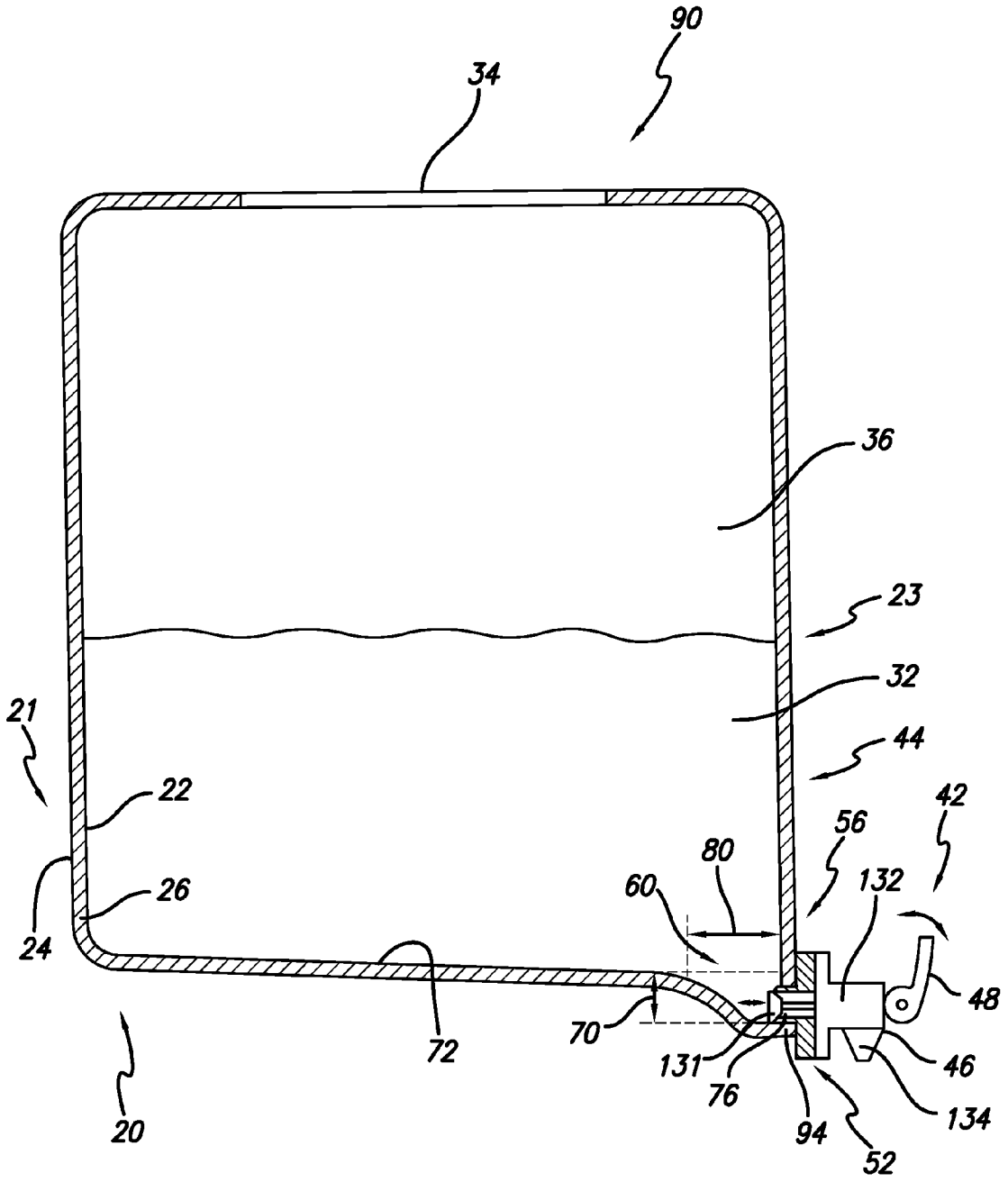
FIG. 1 is a partial fragmentary cross-sectional diagrammatic view of a thermal server to provide some information relating to the characteristics of a thermal server and an interface hub connecting a faucet to a server.

The exemplification set out herein illustrates embodiments of the disclosure that is not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure and is not intended to be exhaustive or to limit the disclosure to the details of construction and the arrangements of components set forth in the following description or illustrated in the drawings.

With reference to FIG. 1, a thermal server 20 is shown defined by a body 23 having an inner layer 22 and an outer layer 24, an evacuated cavity 26 is defined between the inner layer and the outer layer. The thermal container may be in the form of a beverage server such as might be used for receiving, retaining and dispensing coffee. Coffee 32 is dispensed through an upper opening 34 and retained in an inner cavity 36 defined by the inner layer 22. The coffee 32 is retained in the cavity 36 for subsequent dispensing upon demand. A faucet 42 is shown attached to a front face 44 of the server 20. The faucet includes a nozzle 46 and a handle 48 for controlling dispensing of beverage 32 from the server 20. An interface hub 52 is attached to the server 20 at a lower portion 56 thereof. An offset or sump 60 is provided in the lower portion 56 of the server 20 along the front face 44 thereof. The sump 60 is lowered by a dimension 70 which generally is below the bottom surface 72 of the inner layer 22. An outlet port 76 communicates with the sump 60 and the faucet 42. Coffee 32 retained in the cavity 36 drains through the sump 60 and passage 76 to the faucet 42. Alternatively, the container may be insulated by means other than an evacuated space, such as, by way of example of but not limitation, foam insulation material, inert gas, or any other material providing an insulation function.

The sump includes an upper area 80 which has a generally minimal cross sectional area relative to the coffee 32 retained in the cavity 36. The area 80 is minimized so as to minimize the potential heat transfer surface area between the sump and passage 60, 76 and the coffee 32. The coffee 32 has a thermal level which is defined by the temperature of the coffee as it is dispensed into the server or may be supplemented by heating. A variety of heated servers have been produced such as the SoftHeat® server produced by the assignee of the present disclosure.

The interface hub 52 has a minimal thermal mass and, preferably is formed of a material which is generally thermally non-conductive. The interface hub 52 allows a faucet 46 to be connected to the front face 44 of the server. This connection point is in contrast to prior art servers which connected a tube to an opening in the bottom of the server and extended the tube from the bottom of the server forwardly to the front face. Such tubes were relatively long, uninsulated and resulted in heat loss. In the present disclosure, the thermal jacket 21 defined by the layers 22, 24 extends from the upper portion 90 all the way to the lower portion 56. The passage 76 is defined by terminal or sealed ends 92, 94 of the jacket 21. The hub includes an attachment structure 100 and a retaining structure 102. The attachment structure 100 extends from the server 20 to facilitate attachment of a faucet 42. The attachment structure 100 allows the faucet to be glued, fastened, welded or otherwise attached to the structure 100. The retaining structure facilitates retained engagement of the interface 52 with the server. The retaining structure 102 is generally positioned proximate to or in the passage 76 to help facilitate retention of the attachment structure to the server.

The definition of the interface hub 52 is intended to be broadly interpreted including all the embodiments shown herein as well as all extensions and variations thereof. It is envisioned that one with skill in the art may devise a variety of other hub configurations to achieve the same objectives as set forth herein. Objectives include but are not limited to minimizing heat transfer between the beverage contained in the container and the atmosphere external to the container, providing an attachment point for the faucet, retaining the pump on the server.

The sump 60 and the configuration that is generally defined herein help to minimize heat transfer from the volume of coffee connecting the cavity 36 to the faucet 42 for dispensing. Generally, the surface plane 80 is minimized so as to minimize the heat transfer area through which heat may potentially transfer. Additionally, the dimension 70 is minimized relative to the passage 76 so as to minimize the volume and the offset.

The configuration of the server 20 having the offset sump 60 and hub 52 minimizes the temperature loss or heat transfer in the dispensing area. The port 76 is sufficiently offset from the mass of the coffee 36 retained in the server to prevent substantial thermal connection with the hub 52. This configuration also helps contribute to providing the hottest possible first cup dispensed from the server due to the shortest possible path from the larger mass of the coffee 32 to a cup positioned relative to the faucet. The first cup temperature is important such that customers wish to have a predictably hot cup of coffee dispensed from the server.

In prior art devices, the first cup may have a reduced temperature as a result of a sufficiently large volume of coffee retained in the exit port which may extend several inches between the server and the faucet. The present disclosure eliminates the unnecessary length of this dispensing passage. The disclosure creates a sufficient offset at the exit port 76 to prevent or reduce thermal connection from the mass of liquid 36 being held in the container for dispensing at the external faucet 42. This allows the faucet to come to room temperature while the liquid or coffee being held in the container is elevated to approximately 200° F. This offset will prevent constant heat sinking or heat transfer of held coffee through the passage and faucet 76, 42 and/or the connection of the inner jacket and outer jacket at the interface hub.

Figure 2:
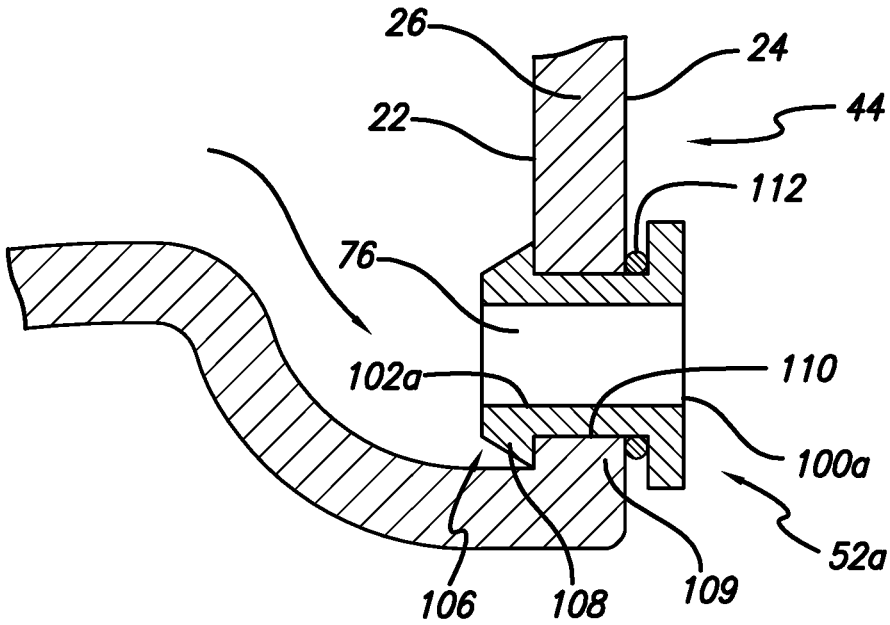
FIG. 2 is another embodiment of an interface hub.
Figure 3:
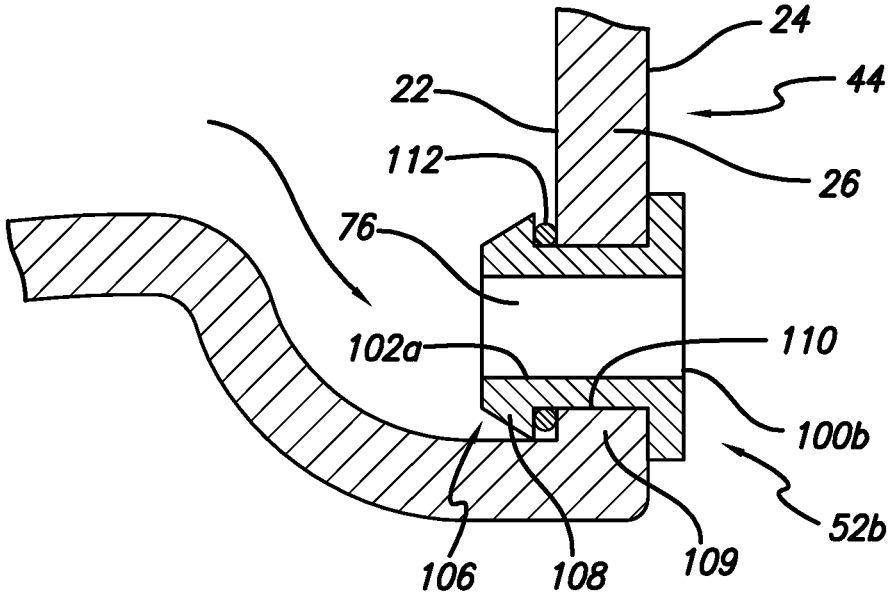
FIG. 3 is further embodiment of an interface hub.

Another embodiment of the interface hub 52*a* as shown in the enlarged, diagrammatic, partially fragmentary cross-sectional drawing of FIG. 2. Interface hub includes an attachment structure 100*a* and a retaining structure 102*a*. The attachment structure, provided generally over the passage 76 but the retaining structure including barbed fingers 106 extending inwardly through the passage 76. The barbed fingers include a barbed end 108 extending from a finger body 110. The barbed end 108 extends over and beyond a rib or edge 109 of the passage 76. A seal 112 is provided between the attaching structure and the server exterior wall 44. The seal could also be provided internally (See FIG. 3) of the server between the barbed 108 or other components of the barbed finger 106 for sealing against an internal surface 22 of the thermal jacket 21. This configuration of the interface hub provides the benefits as generally described above with regard to all similar structures. The embodiment as shown in FIG. 2 facilitates a push-in or snap-in engagement which temporarily deforms the barbs 108 to engage the inner surface 22 of the server. The faucet 42 can be attached to the attachment structure 100*a* as previously described.

Figure 4:
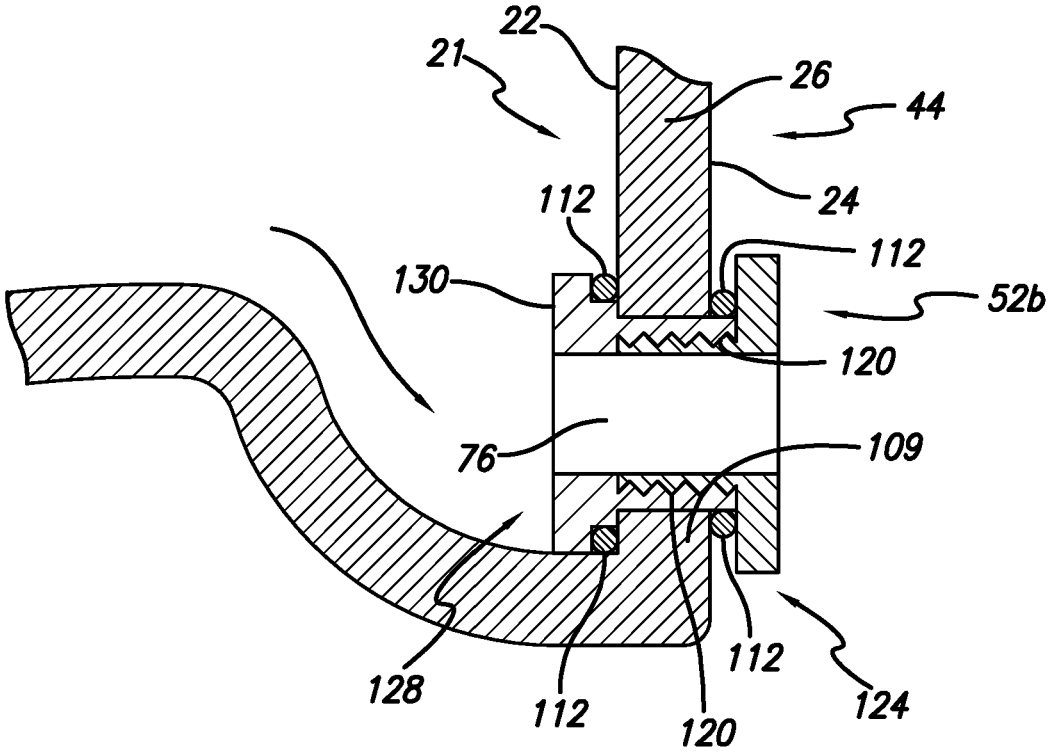
FIG. 4 is yet a further embodiment of an interface hub.

FIG. 4 provides an additional embodiment of the interface hub 52*b*. In this configuration, a threaded portion 120 is provided to facilitate threaded engagement between an external portion 124 and an internal portion 128. Either structure 124, 128 can be a female component or a male component to cooperatively engage a corresponding opposite male or female component. In this regard, the interface hub 52*b* is retained on the server 21 by threaded engagement of the external 24 and internal 128 structures. A seal 112 can be provided between an internal flange and an inside surface 22 of the thermal jacket 21. Similarly, the seal 112 could be placed on an external surface 44 of the server 21.

Additionally, the interface hubs could be attached solely by adhesives, fasteners or other materials or may be attached through anyone of a combination of such methods and materials. Regardless of the specific material or method used to attach the interface hub to the server it is intended that all variations and embodiment of such attachment structure are included in this application.

The hub 52 provides a thermal break between the server body and the faucet 42. The hub can include any number of attachment structures including threaded studs, adhesive contacts, sliding interfaces or any other manner of attachment by which the faucet may be attached to the hub. Additionally, as will be shown in FIG. 5-7, the faucet 42 may include a shaft or passage 130 which can extend into the center passage of the hub for engagement therewith. The manner of attachment of the hub and the faucet to the hub and/or the thermal jacket is intended to broadly interpreted and in no manner limiting as to the scope of the present application.

Figure 5:
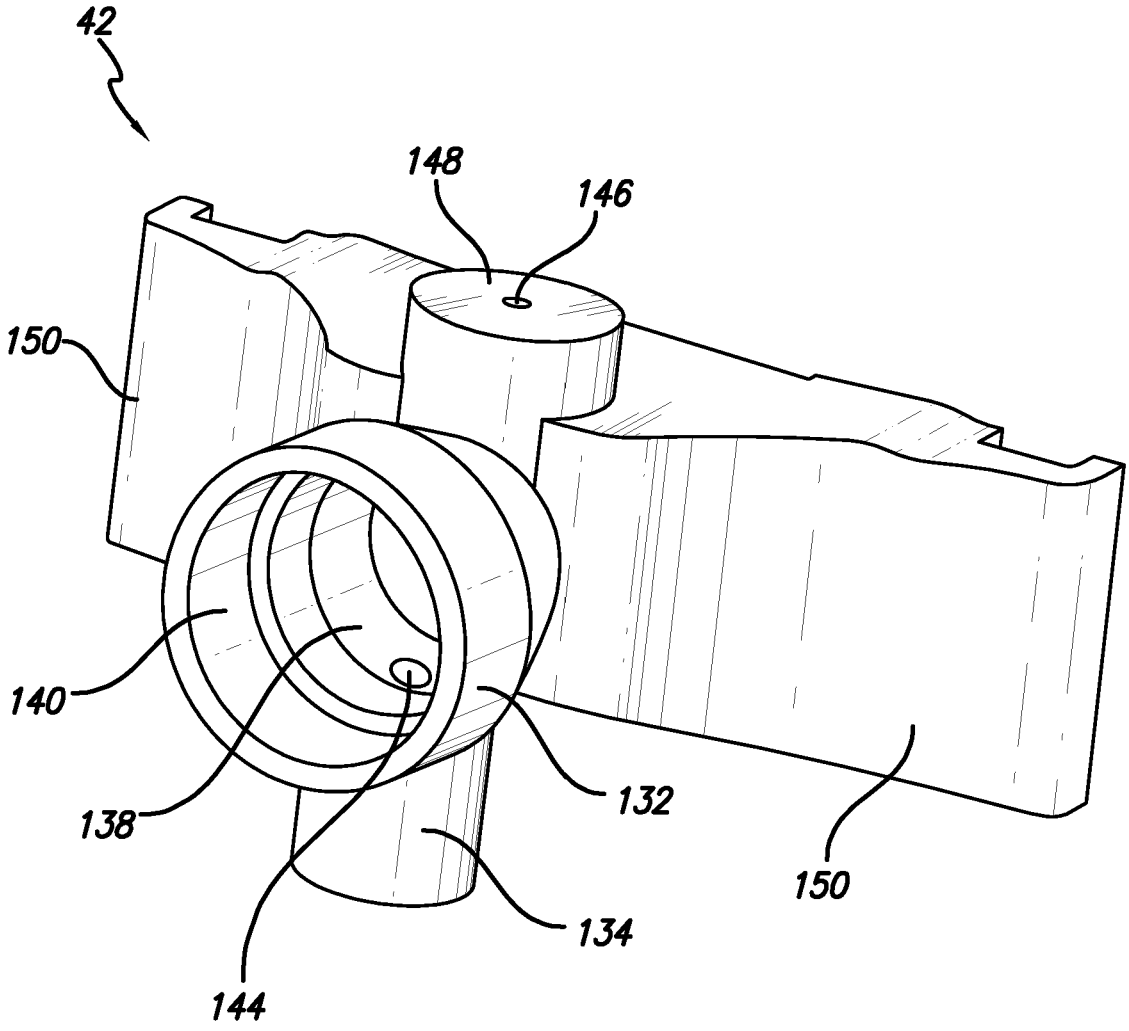
FIG. 5 is a perspective view of a faucet disclosed.
Figure 6:
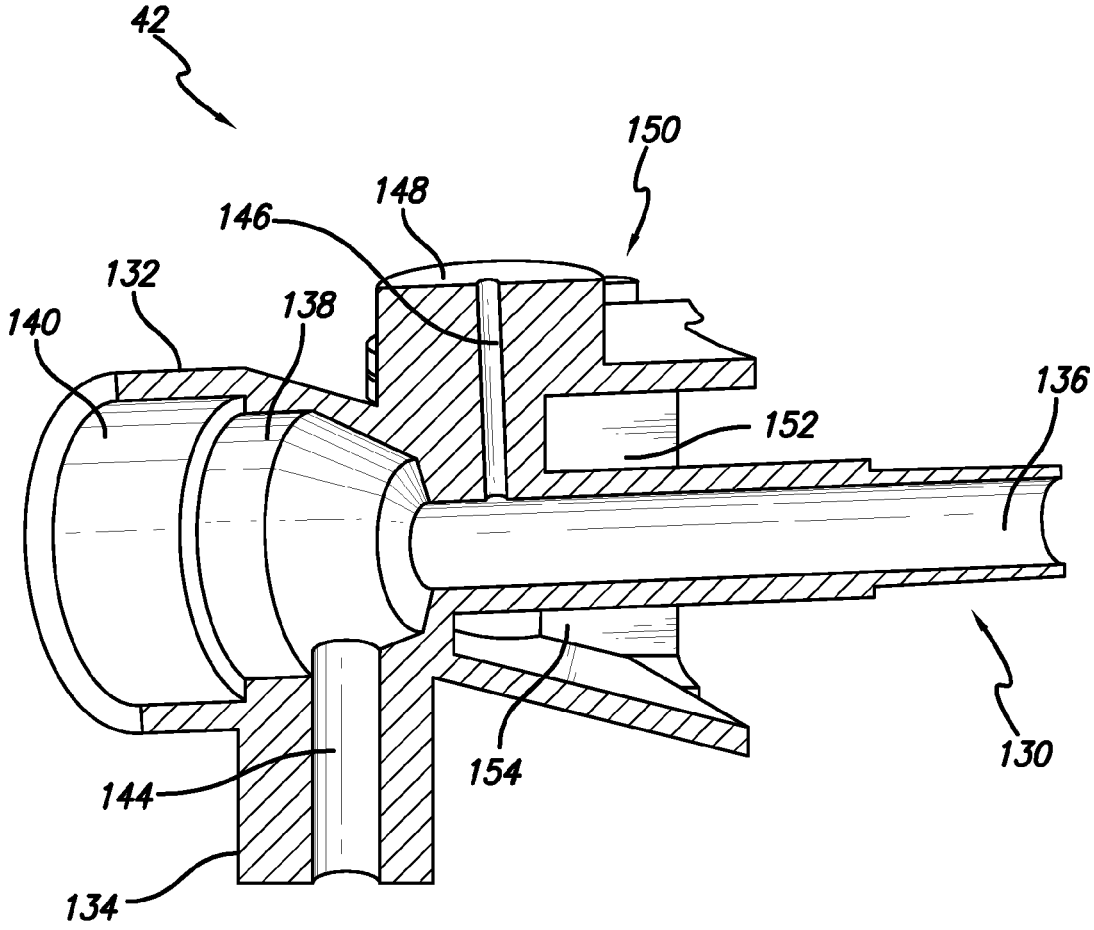
FIG. 6 is a cross-sectional view of the faucet of FIG. 5.
Figure 7:
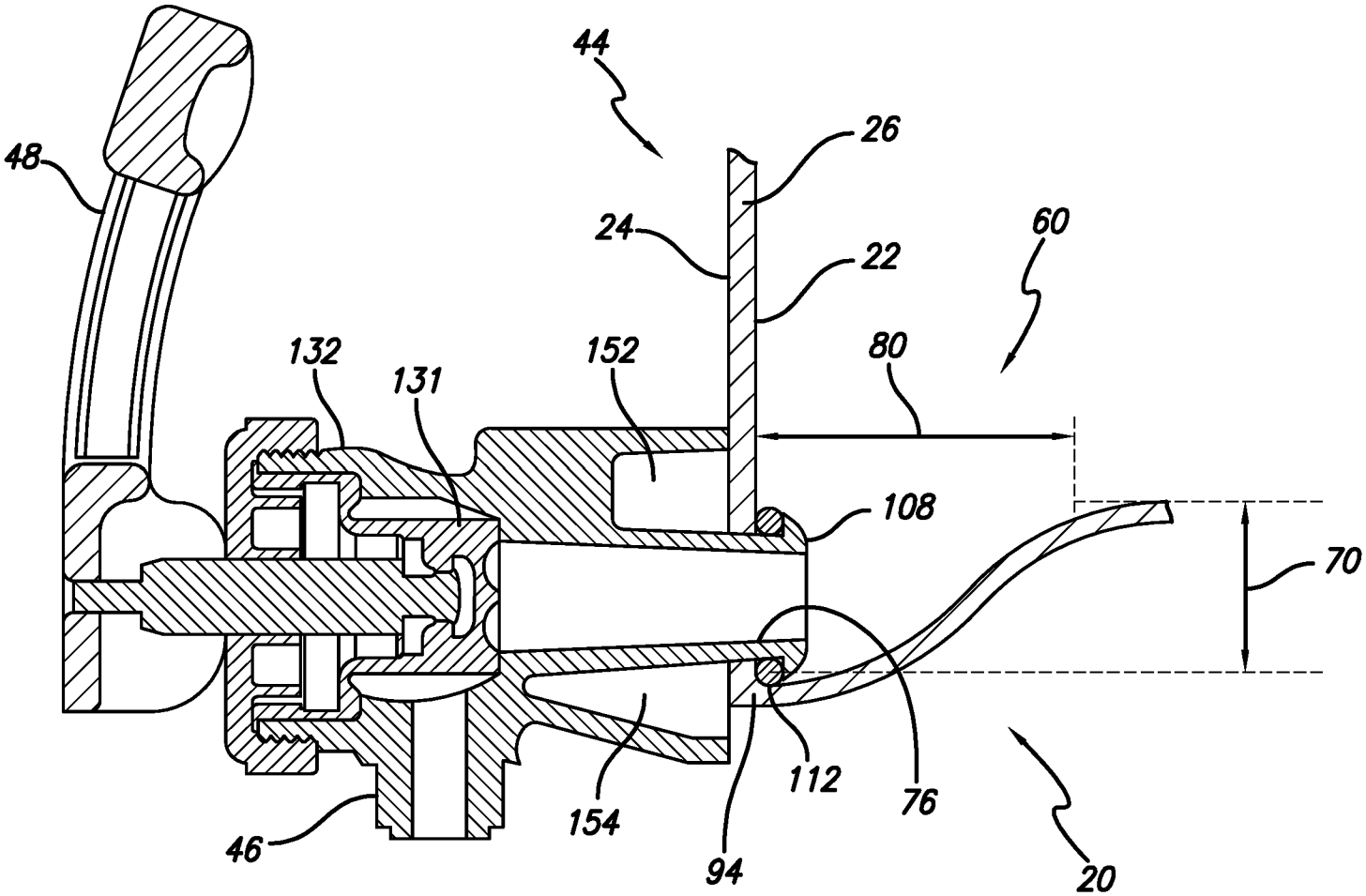
FIG. 7 is a cross-sectional view of a faucet similar to that as shown in FIG. 5 in combination with server as shown in FIG. 1.

With reference to FIGS. 5-7, a faucet 42 is shown. The faucet 42 includes the extending passage 130 as well as a valve housing 132. A nozzle or spout 134 is provided below the faucet housing. The extending portion 130 couples with the interface 52 providing a passage 136 through which coffee or any other heated beverage can flow. With reference to FIG. 1, a stopper or plunger 131 is retained in the faucet body 32. When seated, the stopper 131 seats to seal the passage 76. A handle 48 on the faucet 42 actuates the stopper to shift it into an open position in which it is disengaged from the passage 76. When shifted fluid can flow out through an outlet passage 144. A sight gauge passage 146 is provided communicating with the primary passage 136. A sight gauge can be attached to the shoulder 148 on the top portion of the faucet 42 to facilitate monitoring of coffee levels within the server. The sight gauge attached to the shoulder 48 is generally of known construction and may be of a mechanical, electrical or other form so as to facilitate monitoring of coffee levels in the server.

The faucet 42 as shown in FIGS. 5-7 includes a mounting shoulder 150 extending on either side of the nozzle 134. The mounting shoulders include hollowed areas 152, 154. The hollowed areas of the shoulders 150 help to reduce the thermal mass of the faucet body. The faucet 42 still provides structurally support, reduction of the mass of the faucet helps minimize thermal transfer. The faucet as shown in FIGS. 5-7 is in no way limiting in the present disclosure. Any manner of fastening may be used to attach the faucet body 42 to the server and/or the interface 52.

Additionally, it should be noted that fully intended to be included in this disclosure is the use of a faucet which provides a stopper at the interface (see FIG. 7) or which provides a stopper internally of the server (see FIG. 1). A stopper valve with a stopper positioned exteriorly of the sump 60 may be used with the faucet. The faucet 42 can be configured with a stopper which stops at the interface or the face of the server wall as well as a stopper configuration in which the faucet attaches to a rod which extends interiorly of the server and provides a stopper point on the inside of the server. The use of alternate forms of stoppers may help to further reduce heat transfer. In this regard, stopping the faucet interiorly will help to reduce or eliminate any volume of coffee retained in the passage between the server and the nozzle. By retaining all the coffee to be served within the server, the heat transfer is minimized and all the beverage to be dispensed is retained within the larger thermal mass of coffee retained in the server.

While this disclosure has been described as having an exemplary embodiment, this application is intended to cover any variations, uses, or adaptations using its general principles. It is envisioned that those skilled in the art may devise various modifications and equivalents without departing from the spirit and scope of the disclosure as recited in the following claims. Further, this application is intended to cover such departures from the present disclosure as come within the known or customary practice within the art to which it pertains.

The invention claimed is:

1. A beverage server for retaining a liquid beverage to be dispensed therefrom, the beverage server comprising;

a server body defining an inner cavity;

a sump provided in a lower portion of the server;

a port extending through the body and communicating with the sump; the sump having a relationship with the port to minimize the heat transfer from the liquid in the cavity of the server body, the sump having an upper area and a depth that define a minimal volume of liquid relative to the volume of the cavity; beverage retained in the inner cavity of the server draining towards and into the sump;

a thermally non-conductive interface hub configured with an internal portion inside the server body, an external portion outside the server body and an intermediate portion connecting the internal portion and the external portion, the intermediate portion extending through the port, the hub external portion including attachment structure adapted for attachment to and retaining a faucet on the server, the internal portion including only means for retained engagement of the interface hub with the server body;

a faucet attached to the hub external portion of the server proximate to the sump and communicating with the port, the faucet draining beverage from the server through the sump; and the faucet being configured to reduce thermal loss of a heated beverage retained in the server.

2. The beverage server of claim 1, the server body further comprising an inner layer and an outer layer, the inner layer and outer layer defining an evacuated cavity there between providing thermal insulation relative to the server body.

3. The beverage server of claim 1, further comprising the faucet being configured of a material having a generally low thermal conductivity.

4. The beverage server of claim 1, further comprising the faucet being configured having a minimal thermal mass for reducing the thermal mass material related to heat transferred from the server through the faucet.

5. The beverage server of claim 1, further comprising the interface hub being formed of a material having a generally low thermal conductivity.

6. The beverage server of claim 1, further comprising the interface hub having a minimal thermal mass.

7. The beverage server of claim 1, comprising a port communicating with the sump and the faucet for passage of heated liquid from the server through the sump and to the faucet for dispensing therefrom.

8. The beverage server of claim 1, further comprising the interface hub being constructed for snap fit engagement with the port to facilitate engagement therewith, a seal retained proximate to the hub and the server body for providing a seal between the hub and server body.

9. The beverage server of claim 1, further comprising an interface hub coupled through the server body communicating with the port, the interface hub having each at least a low thermal conductivity for reducing the transfer of heat between the inner cavity of the server and a faucet attached to the interface hub.

10. The beverage server of claim 1, further comprising a stopper of the faucet being positioned generally external to the server body.

11. The beverage server of claim 1, further comprising a stopper of the faucet being positioned generally internal of the server body.

12. The beverage server of claim 1, further comprising the faucet being configured with hollowed areas to reduce thermal mass of the faucet.

13. A beverage server for retaining a liquid beverage to be dispensed therefrom, the beverage server comprising;

a server body defining an inner cavity;

a sump being defined in a lower portion of the server in position generally proximate an inside surface of an inner layer of the beverage server, the sump including an upper area having a generally minimal cross sectional area relative to beverage retained in the cavity, the cross sectional area of the upper area of the sump being minimized so as to reduce the potential heat transfer surface area between the sump and the faucet;

a port extending through the body and communicating with the sump; the sump having a relationship with the port to minimize the heat transfer from the liquid in the cavity of the server body, the sump upper area and a depth of the sump defining a minimal volume of liquid relative to the volume of the cavity; beverage retained in the inner cavity of the server draining towards and into the sump;

a thermally non-conductive interface hub configured with an internal portion inside the server body, an external portion outside the server body and an intermediate portion connecting the internal portion and the external portion, the intermediate portion extending through the port, the hub external portion including attachment structure adapted for attachment to and retaining a faucet on the server, the internal portion including structure for retained engagement of the interface hub with the server body and with no other structure extending into the server from the internal portion;

a faucet attached to the hub external portion of the server proximate to the sump and communicating with the port, the faucet draining beverage from the server through the sump; and the faucet being configured to reduce thermal loss of a heated beverage retained in the server.

14. A server assembly comprising:

a vacuum insulated server body, the server body defining an inner cavity for retaining heated beverage therein, a sump being defined in a lower portion of the server body, a port extending through the server body and communicating with the sump for dispensing heated liquid there through, the sump having a relationship with the port to minimize the heat transfer from the liquid in the cavity of the server body, the sump having an upper area and a depth defining a minimal volume of liquid relative to the volume of the cavity;

a thermally non-conductive interface hub configured with an internal portion inside the server body, an external portion outside the server body and an intermediate portion connecting the internal portion and the external portion, the intermediate portion extending through the port, the hub external portion including attachment structure adapted for attachment to and retaining a faucet on the server, the internal portion including structure configured for retained engagement of the interface hub with the server body and with no other structure extending into the server from the internal portion;

a faucet coupled to the external portion communicating with the port for controllably dispensing heated beverage from the sump through the port and through the faucets, the interface hub positioned between the faucet and server body for thermally uncoupling the faucet and the server body to reduce heat transfer from liquid in the server through the faucet.

15. The server of claim 14, further comprising a faucet formed of at least a generally low thermal conductivity material.

16. A method for reducing transfer of heat from a volume of liquid beverage, the method comprising:

providing a beverage server;

providing a sump, in a lower portion of the server;

providing a port through a wall of the server communicating with the sump; the sump having a relationship with the port to minimize the heat transfer from the liquid in the cavity of the server body, the sump having an upper area and a depth that define a minimal volume of liquid relative to the volume of the cavity;

providing a thermally non-conductive interface hub configured with an internal portion inside the server body, an external portion outside the server body and an intermediate portion connecting the internal portion and the external portion, the intermediate portion extending through the port, the hub external portion retaining a faucet on the server, the internal portion including structure configured for retained engagement of the interface hub with the server body and no other structure extending into the server from the internal portion;

providing a faucet coupled to the hub of the server proximate to and communicating with the port;

dispensing hot liquid beverage into a cavity of the server;

retaining a quantity of the beverage in the server, dispensing hot beverage from the server through the sump, through the port and faucet; and providing a minimal distance between the sump and faucet in which beverage may be retained.

17. The method of claim 16, providing the faucet formed of at least a generally low thermally conductive material for minimizing heat transfer of beverage contacting the faucet.

18. The method of claim 16, further comprising, providing an interface hub, attaching the interface hub to an external portion of the server body proximate to and communicating with the port, attaching the faucet to the interface hub, and providing the interface hub formed of a material which has at least a generally low thermally conductive characteristic.

* * * * *